US007073832B1

(12) United States Patent
LaVaque et al.

(10) Patent No.: US 7,073,832 B1
(45) Date of Patent: Jul. 11, 2006

(54) PINCER TOOL

(75) Inventors: Barry J. LaVaque, 1514 Mendota St., Madison, WI (US) 53704; Robert J. Gold, Madison, WI (US)

(73) Assignee: Barry J. LaVaque, Merrill, WI (US)

( * ) Notice: Subject to any disclaimer, the term of this patent is extended or adjusted under 35 U.S.C. 154(b) by 56 days.

(21) Appl. No.: 10/933,701

(22) Filed: Aug. 26, 2004

Related U.S. Application Data

(60) Provisional application No. 60/497,668, filed on Aug. 25, 2003.

(51) Int. Cl.
*B25B 9/02* (2006.01)

(52) U.S. Cl. ..... 294/99.2; 359/810

(58) Field of Classification Search ..... 294/3, 294/99.2; 359/803, 805, 810, 812, 818; 606/211; 81/6–8; 7/101, 900
See application file for complete search history.

(56) References Cited

U.S. PATENT DOCUMENTS

| | | | | |
|---|---|---|---|---|
| 1,516,955 | A * | 11/1924 | Cusimano | 606/133 |
| 1,765,366 | A * | 6/1930 | Crater | 606/131 |
| 3,510,204 | A * | 5/1970 | Jack | 359/810 |
| 3,744,883 | A * | 7/1973 | Williams | 359/810 |
| 4,836,596 | A * | 6/1989 | Owen | 294/99.2 |
| 5,311,365 | A * | 5/1994 | Klearman et al. | 359/804 |
| 5,358,297 | A * | 10/1994 | Coleman | 294/99.2 |

* cited by examiner

*Primary Examiner*—Dean J. Kramer
(74) *Attorney, Agent, or Firm*—Craig A. Fieschko, Esq.; DeWitt Ross & Stevens S.C.

(57) ABSTRACT

The disclosed invention is a pincer tool comprising two opposably attached arms, one arm ending in an least substantially transparent sight-piece and the other arm ending in a positioning surface comprising at least one indentation well, whereby an item to be viewed such as jewelry or other small items are held in position by the sight-piece, thereby allowing the item to be viewed from directly above the sight-piece.

20 Claims, 1 Drawing Sheet

PINCER TOOL

CROSS REFERENCE TO RELATED APPLICATIONS

This application claims priority under 35 USC §119(e) to U.S. Provisional Application Ser. No. 60/497,668, filed 25 Aug. 2003, the entirety of which is incorporated herein.

FIELD OF THE INVENTION

This invention relates to a mechanical device that facilitates the handling of small items, including, but not limited to, jewelry. More specifically, the invention facilitates the secure grasping of an item without obscuring the view of the item being held via a clear sight-piece. Further, the invention allows for precise visual acuity of the contact surfaces of items held for viewing by providing the user not only an unobstructed view but also a visual targeting capability.

BACKGROUND OF THE INVENTION

The use of hand tools to hold and manipulate various items is well known and spans thousands of years of incremental development. Specifically in the jewelry industry, it has always been a problem to hold, align, attach and solder jewelry components, specifically ring components, without being able to fully see the actual surfaces that are the object of the craft-person's attention. The inability to directly view the item being worked on creates additional difficulties for the user. For example, many jewelers use heat and pressure on items being worked on, such as when soldering a crown to a ring. When incorrectly applied, heat and pressure can damage the structure of the ring. Therefore, a need exists for a tool that allows a user to directly view an item being held for viewing.

Conventional tools in the art compress the individual items to be viewed between two opaque tool surfaces made of metal. This creates an obscured clamped position in which the user tries to visually align the items viewed. For instance, a conventional tool holds an item to be viewed at a perpendicular angle against a solid surface such as metal. In use, a jeweler desiring to solder a crown to a ring held by such a tool cannot properly see the alignment required because of the solid nature of the surface holding the ring in position. In many instances, the work must be redone after inspection because the alignment was improperly positioned due to the user's inability to view the item directly from above. Because the opaque nature of the surface securely holding the item in position prevents the user from having a direct view of the item, there exists a need for a tool that allows the direct viewing of an item being held perpendicularly against a viewing surface.

Still other conventional tools require the user to use both hands merely to hold the items to be worked on in the required position. This is inefficient and requires either another person to complete the work or another tool to hold the tool holding the item. Alternatively, if one hand can be used to hold the tool securing the item, the tool is often bulky and uncomfortable for the user after extended periods of use.

Therefore, there exists a need in the jewelry field and in other detailed work environments for a simple tool that can be held in one hand by a user and allow the user to hold and view items that require precise alignment of single or multiple components. While several patents address clamping capabilities for various types of equipment, no existing patent or combination of patents address the combined elements that give the current invention its unique and novel abilities and characteristics.

SUMMARY OF THE INVENTION

The current invention is a pincer tool for holding an item to be viewed comprising a first arm opposably attached to a second arm, the first arm ending in a clear sight-piece and the second arm ending in a flat item mount. The sight-piece has a viewing surface, through which the user looks down onto the item being held for viewing, and a contact surface, which contacts the item, thereby securing the item in position. The item mount preferably contains a series of indentations of varying sizes and shapes for accommodating items of varying sizes and shapes. However, the item mount may also be free of any indentations and still support an item to be viewed.

In use, an item to be viewed is positioned on the item mount of the second arm and the first arm is adjusted by compressing it toward the second arm, bringing the contact surface of the at least substantially transparent sight-piece into direct contact with the item to be viewed. The pressure between the contact surface of the sight-piece and the item securely holds the item in position on the item mount. The item is preferably positioned directly perpendicular to the sight-piece, thereby allowing the user to directly view the item. However, the item can also be secured in positions of varying angles to the sight-piece. This allows the user to comfortably hold the pincer tool of the present invention in one hand while doing any necessary detailed work, such as soldering, with the other hand. By allowing the user to view the item being held directly at the point of contact between the sight-piece and the item, the user avoids the problems of the prior art.

While the preferred embodiment allows the user to hold the pincer tool in one hand while doing the necessary work on the item with the other hand, additional attachments and adjustable components can be incorporated within the invention. For example, attachments for such purposes as to clamp different sized or shaped items, as well as to see, sense and display pressure and heat characteristics of soldering procedures being performed on the items being held can also be incorporated. Further attachments allow enhanced viewing options of the clamped item, such as a microscope.

The first arm is adjustably attached to the second arm so that the user can adjust the angle of displacement between the two arms. This allows the user to adjust the angle of contact between the contact surface of the sight-piece and the item to be viewed. In use, the user can then position the item so it is, preferably, perfectly square with the contact surface of the sight-piece. Further, while in the preferred embodiment the user simply holds the tool at the desired pressure needed to keep the item, the position of the first arm may be secured at a desired position through the use of a clamping means such as a simple sliding pressure adjustment system. This allows the user to use both hands to complete the detailed work on the item. Further, setting the position of the first arm allows the user to make any necessary adjustments to the angular displacement of the two arms while continuing work on the item. Thereby, the best pressure and arm angle for the specific item being viewed is applied. Additionally, if small changes to the angular displacement of the arms is required, the adjustments can be achieved with a minimum of adjustment, minimizing any disruptions in the work being done on the item.

The sight-piece can be made of any at least substantially transparent material. Preferably, the sight-piece is made from a durable, scratch-proof material that is resistant to heat and pressure such as glass or transparent plastic, including, but not limited to such materials as polymethylmethacrylate, cellulose acetate butyrate, polycarbonate, glycol-modified polyethylene terphthalate, soda-lime glass, lead glass, borosilicate glass, aluminosilicate glass, silica glass or fused silica glass. However, any substantially transparent material may be used for the sight-piece, so long as a direct view of the item being held is allowed.

The sight-piece includes a contact surface which directly contacts the item. The contact by the sight-piece holds the item on the item mount of the second arm. The sight-piece further includes a viewing surface, whereby the user can directly view the item held in position by the contact surface from above the tool.

The sight-piece can be hingedly or fixedly attached to the first arm. A sight-piece that is fixedly attached increases the rigidity of the tool, making it more comfortable for the user to use for extended periods of time. Further, a fixedly attached sight-piece requires less adjustment of the sight-piece when in contact with the item, as the pressure exerted on the first arm moves the sight-piece to the required position in contact with the item. A hingedly attached sight-piece increases the utility of the tool by allowing the user to view larger items, as well as to view items from different angles. Regardless of whether the sight-piece is fixedly or hingedly attached to the first arm, the sight-piece can be simply and securely replaced. Further, a series of interchangeable viewing sight-pieces can be used having printed or etched reticule lines that facilitate precise visual alignment of items.

The item mount of the second arm preferably comprises a wide, flat surface. In the preferred embodiment, the item mount includes several indentations spaced along the length of the item mount. The indentations are preferably defined by elongated grooves curving downwardly into the item mount from between opposing ends to form an indentation complementary in shape to the dimensions of an item to be viewed. The indentation wells are preferably of various widths, depths and lengths, thereby allowing the positioning of a variety of sizes of items to be viewed. The dimensions of the indentation are such than an item is supported and stabilized in position for viewing. Further, the indentations can be positioned at various angles to each other. For example, the indentations can be a series of evenly-spaced, parallel grooves positioned along the entire length of the item mount. Alternatively, the indentations can be positioned perpendicularly to each other along the length of the item mount. The indentations can also be positioned at other angles to each other. The variety of the positions of the indentations allows the user to choose the indentation best suited to provide the desired support and stability to the specific item.

While in the preferred embodiment the item mount is fixedly attached to the second arm, it is also within the scope of the invention for the item mount to be movably attached to the second arm. This allows the item mount to be moved along the length of the second arm, thereby allowing the user to adjust the position of the item mount as required to view a specific item.

The tool of the present invention represents many advantages over the prior art. For instance, this tool provides a user the ability to directly view a single item, such as a complete piece of jewelry or ring, or an item consisting of multiple components, such as a ring and crown that are not yet soldered together, while the items are securely held by the pincer tool of the present invention. Advantageously, the user can view the item through the sight-piece from a vantage point that would normally be blocked by the tool while the user easily and comfortably holds the entire tool in one hand. The present invention allows the user to securely hold an item to be viewed, such as a ring and crown, in a position that allows the items to be held in place while still allowing easy physical alignment with one hand while the second hand holds the entire pincer tool. Further, the tool of the present invention can be simply and easily operated with one hand, freeing the other hand of a user to complete any necessary detailed work such as soldering.

Advantageously, the user is further provided with the capability of holding items of various sizes through the preferred series of indentations located on the item mount of the second arm. Further, the versatility of this invention is such that the user can incorporate auxiliary components such as an electronic sensor system to accurately and precisely measure the pressure or heat applied to an item, as well as an additional tool arm to hold or position a supplementary component such as a light source.

Further advantages, features, and objects of the invention will be apparent from the following detailed description of the invention in conjunction with the associated drawings.

DETAILED DESCRIPTION OF THE INVENTION

Figure 1:
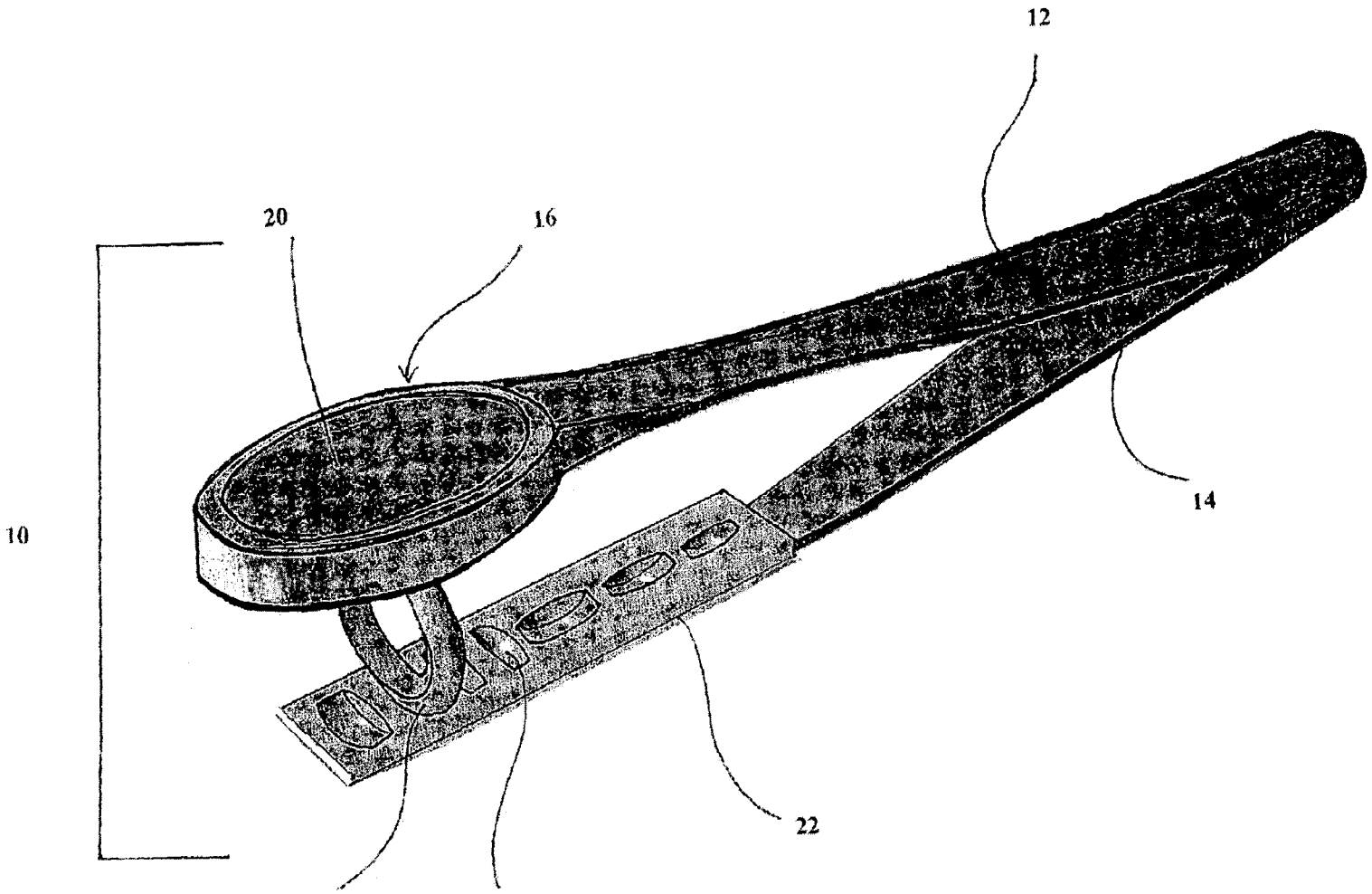
FIG. 1 is a left perspective view of the pincer tool of the present invention.

It should be understood that the version of the invention described in the Summary above is merely an exemplary preferred one, and numerous modifications to the pincer tool 10 are also considered to be within the scope of the invention.

In the preferred embodiment, the present invention is a pincer tool 10 for holding items 11 in a work-detailed environment such as the jeweler's industry. Referring to FIG. 1, the pincer tool 10 comprises a first arm 12 opposably attached at the proximal end to a second arm 14. The distal end of the first arm 12 comprises a fixedly-attached sight-piece 16, the sight-piece 16 having a contact surface (not shown) and a viewing surface 20. The distal end of the second arm 14 comprises a flat, linear item mount 22. The item mount 22 preferably contains a series of indentations 24 spaced along the length of the item mount 22.

In use, the item to be viewed 11 is inserted into the desired indentation 24 on the item mount 22 of the second arm 14. The user then adjusts the first arm 12 to the desired position by compressing the first arm 12 towards the opposing second arm 14 until the contact surface of the sight-piece 16 presses against the item 11. The item 11 is secured in position by the pressure of the contact surface of the sight-piece 16 against the item 11. The item 11 is positioned perpendicular to the contact surface of the sight-piece 16 and can therefore be viewed directly by the user through the viewing surface 20 of the sight-piece 16. However, depending on the configuration of the indentations 24, the item 11 may be positioned in other angles against the sight-piece 16.

Preferably, the user holds the pincer tool 10 with the secured item 11 in one hand while completing the necessary work with the other hand. However, it is within the scope of this invention to use a means of securing the pincer tool 10 such that the first arm 12 remains compressed without the user holding the tool 10. For instance, a simple pressure assembly adjustment system (not shown) may be used to secure the first arm 12 in position, thereby securing the item 11 against the contact surface of the sight-piece 16. The pressure adjustment system may consist of something as simple as a clamping means such as a clamp or bolt (not shown). Such a system allows the user to use both hands to work on the item 11 and allows any required changes in the position of the first arm 14 or the sight-piece 16 to be made with a minimum of interference in the work being done on the item 11.

The first arm 12 is joined to the second arm 14 at their proximal ends. Both the first arm 12 and second arm 14 are preferably made of a sturdy material such as metal or plastic that allows the user to easily manipulate the tool 10 to accommodate the various items being viewed 11 while providing the required support and stability for the detailed work required. The sight-piece 16 is preferably fixedly attached directly to the distal end of the first arm 12.

The sight-piece 16 is preferably formed from a clear or transparent, durable and scratch-proof material such as Pyrex® glass or transparent plastic. However, any material that is substantially transparent will work. Transparent materials such as glass and plastic have an index of refraction about that of air; therefore, any other material with a similar index of refraction would suffice. Such materials include, but are not limited to, polymethylmethacrylate, cellulose acetate butyrate, polycarbonate, glycol-modified polyethylene terphthalate, soda-lime glass, lead glass, borosilicate glass, aluminosilicate glass, silica glass or fused silica glass. High-quality glass is preferred due to the improved viewing capabilities of the material, but such high-quality glass is often very expensive and susceptible to breakage. While transparent plastics only transmit approximately 92% of light as compared to glass, such plastics are much more resistant to breakage and are easier to fabricate.

The distal end of the second arm 14 of the pincer tool 10, the end opposite the joined end of the arms 12 and 14, comprises a flat, linear, item mount 22. The item mount 22 preferably contains a series of indentations 24 spaced on the length of the item mount 22. Each indentation 24 is defined by an elongated groove curving downwardly into the item mount 22 from between opposing ends in a manner dimensioned and configured to accommodate a variety of different sized items 11. In the preferred embodiment, at least one but up to four or six wells 24 are located on the item mount 22.

The dimensions, such as the length, depth and width, of the indentations 24 may vary depending on the specific needs of the user. Further, the indentations 24 may be oriented along the item mount 22 in a variety of positions. For instance, a jeweler may want the item mount 22 to include a series of indentations 24 that corresponds to the widths and diameters of commonly seen rings. Therefore, the indentations 24 may consist of a series of parallel grooves of various depths, lengths and widths. Alternatively, the indentations 24 may be positioned perpendicularly to each other. Further, the indentations 24 can be positioned at a variety of angles along the length of the item mount 22. The needs of the user may determine the position and dimensions of the indentations 24. However, it is also foreseen by the scope of this invention that the item mount 22 will not contain any indentations 24.

While in the preferred embodiment the item mount 22 is a fixed part of the second arm 14, it is within the scope of the invention for the item mount 22 to be slidably attached to the second arm 14. For instance, the second arm 14 may contain an adjustable attachment boss (not shown) which slides into a linear channel (not shown) located on the underside of the second arm 14. The attachment boss may be inserted into the channel on the second arm 14 via a pass-through hole running the length of the second arm 14. Two holes located on the underside of the second arm 14 can accept a retention bolt (not shown) to secure the item mount 22 in alternate positions on the attachment boss. The slidably attached item mount 22 allows the user to position the item mount 22 in a variety of locations along the second arm 14, thereby increasing the size and dimensions of an item 11 that may be viewed. One skilled in the art will know that there are many adaptations of this tool 10 that can be made. All are included in the scope of this invention.

Alternative embodiments of the pincer tool 10 of the present invention also contemplate having each indentation 24 be adaptable to the insertion of additional sensors such as pressure or heat sensors from underneath the tool 10. This would allow the user to measure the exact heat and pressure being used on the item 11 in real time, thereby increasing the utility of the invention.

The sight-piece 16 can also be attached to the tool 10 in a variety of ways. While in the preferred embodiment the sight-piece 16 is fixedly attached directly to the distal end of the first arm 12, as shown in FIG. 1, an alternate embodiment exists wherein the first arm 12 ends in a "U" shaped support structure (not shown) which holds the sight-piece 16 in position. Having a support structure hold the sight-piece 16 allows the sight-piece 16 to be replaced with greater ease and efficiency. The support structure comprises an open circle of sturdy material such as metal which contains at least two open holes and for securing the sight-piece 16 via a means of retention such as a bolt or screw (not shown). For purposes of brevity, a retention bolt is described in this application, but other means of retention are contemplated.

In use, the sight-piece 16 is inserted into the support structure, which is then tightened around the sight-piece 16 and secured using the retention bolt. When the retention bolt is loosened, the sight-piece 16 can be removed and replaced with one of a number of different sight-pieces 16. For instance, a worn or used sight-piece 16 may be replaced with a new sight-piece 16. Or, the user may required a specialized sight-piece 16 for use on a specific item 11, such as a sight-piece 16 containing etched or printed lines to visually help the user accurately position an item 11.

In yet another alternative embodiment, also not shown, the sight-piece 16 may be hingedly attached directly to the distal end of the first arm 12 opposite the joined end of the arms 12 and 14 through a simple hinge mechanism. The hinge mechanism attaches the sight-piece 16 to the distal end of the first arm 12 so that the sight-piece 16 can rotate in an arc of at least 180 degrees on the hinge. In use, the hingedly attached sight-piece 16 is rotated 90 degrees away from the second arm 14 so the item to be viewed 11 can be placed in the proper indentation 24 on the item mount 22. Once the item 11 is in position, the sight-piece 16 is rotated 90 degrees towards the second arm 14 so that the contact surface of the sight-piece 16 contacts the item 11 in a, preferably, perpendicular position. The hingedly attached sight-piece may then be locked into place by a hinge-securing mechanism such as a locking nut and bolt passing through the hinge. Other means of securing the hinge can also be used, such as additional clamps. Further, the sight-piece 16 can be adjusted to allow varying degrees of angles of sight to be used.

While the preferred embodiment shown in FIG. 1 shows no extraneous attachments or components, it is within the scope of this invention to accommodate such attachments. For instance, a pressure sensor may be inserted into any location beneath the indentations 24 located on the item mount 22. The flexible pressure sensor allows the item 11, such as a ring, to be accurately monitored in real time, informing the user of the pressure imposed on the item 11 from the contact surface of the sight-piece 16. Further, a second sensor for heat may be inserted in the same manner as the pressure sensor. A flexible heat sensor may be articulated to place the sensor's tip in a position of contact with the area of the item 11. When heat is applied to the item 11, the heat sensor can transmit real-time data to the user. Additionally, a single sensor can be used to measure and transmit heat and pressure data simultaneously.

An additional set of accessory components can be used in conjunction with the pincer tool 10 of the present invention to enhance the functionality of the invention by permitting a macro view of the item being held 11 for viewing via an attachable microscope viewer (not shown). For example, an optical scope unit can be placed against the viewing surface 20 of the sight-piece 16. This allows the user to get an even closer, more accurate view of the item being viewed 11.

Further, an additional gripping component can be used to allow the user to hold the pincer tool 10 in one hand and work on the item 11 with the other hand while simultaneously holding an accessory component such as a light source. For instance, an additional gripping component (not shown) can be positioned to hold a light source, or any other desired attachment, adjacent to, or in contact with, the item 11. The light source can be self-powered or work off the power source of the pressure or heat sensors.

The combination of features in the present invention provides a highly advantageous system for the clamping, holding and alignment of items 11 such as jewelry or other small items. The pincer tool 10 of the present invention is simple to use and easy to understand. While the above description contains much specificity, these should not be construed as limitations on the scope of the invention, but rather as an exemplification of one preferred embodiment thereof. Many other variations are possible and can be envisioned by anyone skilled in the art without leaving the scope of the intent of the invention.

The invention is not intended to be limited to the examples described above, but rather is intended to be limited only by the claims set out below. Thus, the invention encompasses all different versions that fall literally or equivalently within the scope of these claims.

What is claimed is:

1. A tool comprising:

a. a first arm extending between an attachment end and an at least substantially transparent sight-piece, the sight-piece having a viewing surface and an opposing contact surface; and b. a second arm extending between the attachment end and an opposing item mount, the item mount being movable on the second arm, whereby an item to be viewed may be situated on the item mount, and the first arm is adjustable toward the second arm such that the contact surface contacts the item to be viewed, the item to be viewed thereby being held by the contact surface on the item mount for viewing through the viewing surface of the sight-piece.

2. The tool of claim 1 wherein the item mount has indentations defined therein.

3. The tool of claim 2 wherein the indentations are defined by elongated grooves extending between opposing ends.

4. The tool of claim 3 wherein the grooves are of different sizes.

5. The tool of claim 3 wherein the opposing ends of the grooves are oriented at different angles to each other.

6. The tool of claim 1 wherein the first and second arms are at least substantially rigid, and are adjustable toward and away from each other by pivoting with respect to each other at the attachment end.

7. The tool of claim 1 wherein the sight-piece is made from mesh.

8. A tool comprising:

a. a first arm and a second arm attached at an attachment end;

b. the first arm having a sight-piece; and c. the second arm having an item mount closely spaced from the sight-piece of the first arm, the item mount including at least one indentation defined therein, wherein the indentation is defined by an elongated groove curving downwardly into the item mount between opposing ends, whereby:

1. an item to be grasped and viewed may be situated on the item mount of the second arm; and 2. the first and second arms may be resiliently flexed towards each other to cause the sight-piece and item mount to approach the item.

9. The tool of claim 8 wherein the sight-piece is made from at least one of the following:

a. a transparent solid, or b. a mesh.

10. The tool of claim 8 wherein the sight-piece is fixedly attached to an end of the first arm opposite the attachment end.

11. The tool of claim 8 wherein the item mount is movably attached to the second arm.

12. The tool of claim 8 wherein the item mount includes at least two indentations defined therein, the indentations being defined by grooves of different sizes.

13. The tool of claim 8 wherein the item mount includes at least two indentations defined therein, the indentations being defined by grooves oriented at different angles.

14. A tool comprising:

a. an at least substantially transparent sight-piece having a viewing surface and an opposing contact surface, wherein a user may view an item on the contact surface through the viewing surface; and b. an item mount having indentations defined therein, the indentations being defined by an elongated groove curving downwardly into the item mount between opposing groove ends, whereby the sight-piece and item mount are situated on opposing resiliently flexible arms, wherein the user may flex the arms inwardly to cause the sight-piece to approach the item mount.

15. The tool of claim 14 wherein the opposing ends of the grooves are positioned at various angles to each other.

16. The tool of claim 14 wherein each groove is differently sized.

17. The tool of claim 14 wherein the arms are joined at an attachment end.

18. The tool of claim 17 wherein the sight-piece is attached to an arm at an end opposite the attachment end.

19. The tool of claim 17 wherein the item mount is attached to an opposing arm at an end opposite the attachment end.

20. The tool of claim 14 wherein the sight-piece is made from mesh.

* * * * *